United States Patent [19]

Sulzer

[11] Patent Number: 4,889,384

[45] Date of Patent: Dec. 26, 1989

[54] KNEE-ACTION CHAIR CONTROL

[75] Inventor: James H. Sulzer, Cedarburg, Wis.

[73] Assignee: Leggett & Platt, Incorporated, Carthage, Mo.

[21] Appl. No.: 205,383

[22] Filed: Jul. 10, 1988

[51] Int. Cl.[4] ..... A47C 3/00

[52] U.S. Cl. ..... 297/302; 297/304; 297/326; 248/575

[58] Field of Search ..... 297/302, 300, 301, 303, 297/304, 325, 326, 327, 328; 248/575, 573, 561, 578, 566, 608, 609

[56] References Cited

U.S. PATENT DOCUMENTS

| | | | |
|---|---|---|---|
| 144,349 | 11/1873 | Morrison et al. . | |
| 599,502 | 2/1898 | Hanson et al. . | |
| 1,335,883 | 4/1920 | Elton . | |
| 1,433,694 | 10/1922 | Atwood . | |
| 1,674,846 | 6/1928 | Streit . | |
| 2,818,911 | 1/1958 | Syak . | |
| 3,178,148 | 4/1965 | Manke | 248/575 |
| 3,417,956 | 12/1968 | Helms . | |
| 3,480,249 | 11/1969 | Lie . | |
| 3,627,252 | 12/1971 | Yamaguchi . | |
| 3,936,094 | 2/1976 | Conrad . | |
| 4,018,415 | 4/1977 | Wolters . | |
| 4,099,775 | 7/1978 | Mizelle . | |
| 4,438,898 | 3/1984 | Knoblauch et al. . | |
| 4,537,445 | 8/1985 | Neuhoff | 297/300 |
| 4,555,085 | 11/1985 | Bauer et al. . | |
| 4,695,093 | 9/1987 | Suhr et al. | 297/300 |
| 4,711,491 | 12/1987 | Ginat . | |
| 4,744,600 | 5/1988 | Inoue | 297/300 X |

FOREIGN PATENT DOCUMENTS

| | | | |
|---|---|---|---|
| 3436964 | 4/1986 | Fed. Rep. of Germany | 297/300 |
| 340976 | 10/1959 | Switzerland | 297/304 |

OTHER PUBLICATIONS

Sketch of Herman Miller Co. Knee-Action Chair Control.

*Primary Examiner*—Kenneth J. Dorner
*Assistant Examiner*—José V. Chen
*Attorney, Agent, or Firm*—Wood, Herron & Evans

[57] ABSTRACT

A knee-action chair control for a pedestal chair base comprises a base plate, a seat support plate pivotally mounted on the front of the base plate, a pair of compression springs operable between the plates for biasing the seat support plate toward an at-rest position relative to the base plate, and a novel adjustable spring preload mechanism operable between the base plate and one end of the compression springs. Additonally, there is an assembly locking plate removably mounted on the seat plate and engageable with the base plate for determining the at-rest position of the seat plate. Removal of the assembly locking plate during assembly of the control enables the compression springs and spring preload mechanism to be assembled without precompression of the springs.

9 Claims, 6 Drawing Sheets

KNEE-ACTION CHAIR CONTROL

The present invention relates to chair controls. Chair controls are devices typically mounted beneath the seat of a chair to control the tilting of the chair when a person leans back in it. They usually comprise a base member or plate adapted to be mounted on a chair pedestal base and a tiltable chair support member or plate pivotally mounted to the base plate. The tiltable chair support plate is in turn secured to the chair seat and/or back. There is a bias member or energy storing device which controls the rate at which one can tilt rearwardly in the chair with the application of a given force and which returns the chair to its normal at-rest position when the user stops leaning back.

Traditional chair controls have been pivoted at a point very near the center line of the base plate, which also generally coincides with the center of gravity of the occupant seated in the chair. Accordingly, tilting of the chair backwards requires very little force, but raises the front of the chair seat, creating a pressure on the back of the thigh, which pressure disturbs blood circulation and usually requires the occupant to exert considerable force through extension of the foreleg and toes to maintain the tilt position. The result is seldom as relaxing as it should be.

Relatively recently, there have been developed knee-action chair tilt controls such as the controls disclosed in U.S. Pat. Nos. 3,627,252, 3,480,249 and 4,711,491. These knee-action chair controls function to pivot the chair seat support plate as near the natural knee joint as possible so that the front of the seat rises very little or not at all upon rearward tilting of the chair. With a larger portion of the occupant's weight distributed behind the control pivot, little or no effort is required to maintain a reclined position, and the feet of the reclining person can remain flat on the floor with no effort.

The price paid for knee-action chair controls, as opposed to the traditional control which pivots near the center of the chair seat, is that a much greater force is required to support the occupant on the extended moment arm and to return the reclined person to the erect position. Springs for providing such force tend to become very massive and visually unattractive because they must be encased within a relatively large, unsightly control mechanism.

It has therefore been an objective of this invention to provide an improved knee-tilt chair control mechanism which is comfortable and easy for the chair occupant to use, but which is also attractive in appearance, as well as capable of manufacture at a reasonable cost.

The chair control which accomplishes this objective comprises a base plate which is to be mounted upon a chair pedestal base with means located adjacent the rear portion of the base plate for securement of the base plate to a vertical column of the pedestal base. A seat support plate is pivotally secured to the front of the base plate. There is at least one compression spring operatively associated with the base plate and seat support plate, for biasing the seat support plate toward an at-rest position of the seat support plate relative to the base plate, and an adjustable spring preload mechanism associated with the biasing spring for varying the compression preload of the spring. The preload mechanism comprises a generally wedge-shaped cam actuator mounted over a sleeve which extends between one end of the spring and the base plate. The cam actuator has cam surfaces on opposite sides thereof, which cam surfaces are engageable with cam surfaces of a pair of annular cams mounted over the sleeve on opposite sides of the cam actuator. A threaded shaft connects the cam actuator to a rotatable handle by means of which the cam actuator can be adjusted laterally relative to the annular cams so as to move the annular cams toward and away from one another to vary the preload of the springs. Additionally, there is an assembly locking plate mounted on the front side of the seat support plate and engageable with the base plate to determine the at-rest position of the seat support plate relative to the base plate. The assembly locking plate is removable from its mounting on the seat support plate during assembly of the chair control so as to enable the seat support plate to be tilted beyond the at-rest position of the seat support plate relative to the base plate for compression-free assembly of the compression springs between the seat support plate and base plate, and then compressed between those plates while the assembly locking plate is mounted on the front side of the seat support plate. The use of this assembly locking plate enables the complete chair mechanism to be assembled without having to compress the springs until the springs and the preload adjustment mechanism have all been assembled internally of the chair control.

The primary advantage of this new chair control is that it is aesthetically pleasing in appearance, functions to provide a comfortable tilting chair mechanism which is easy to operate with a minimum of physical effort, and which is still relatively inexpensive to manufacture and assemble.

These and other objects and advantages of this invention will be more readily apparent from the following description of the drawings in which.

Figure 1:
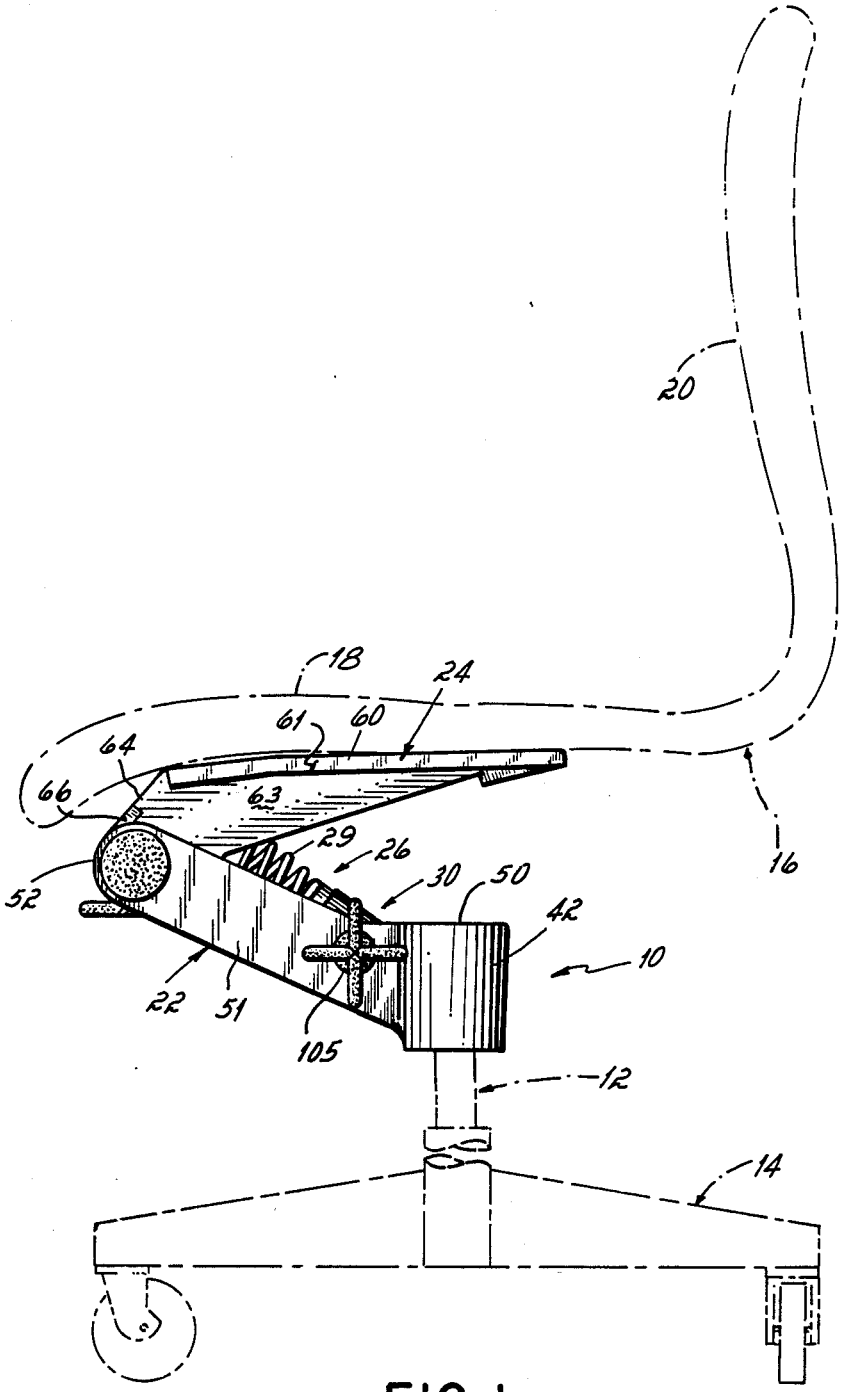
FIG. 1 is a side elevational view of a chair control embodying the invention of this application and illustrating the chair pedestal base and the chair seat in phantom for purposes of showing how the control is mounted on a chair.
Figure 2:
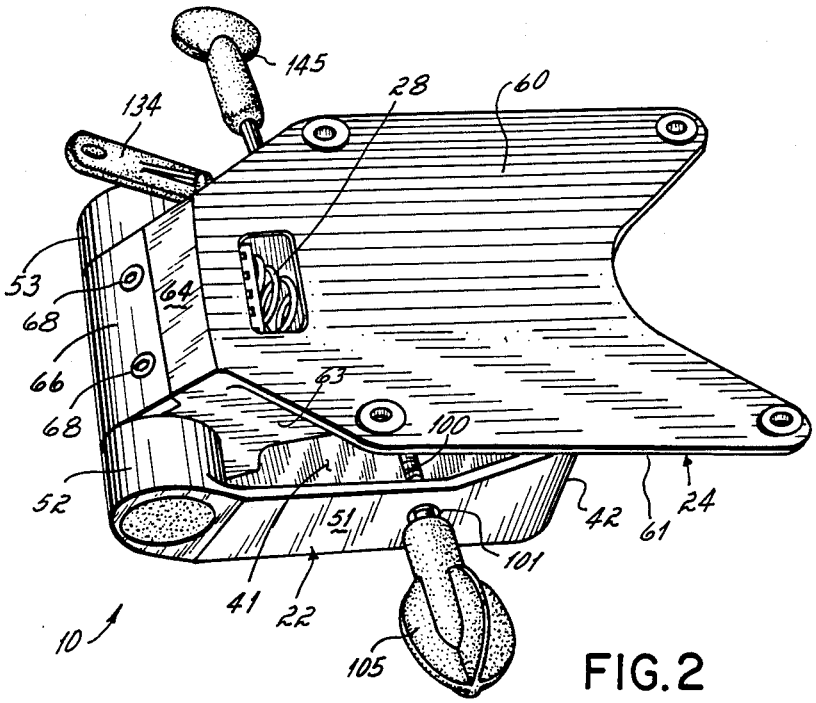
FIG. 2 is a perspective view of the top of the chair control of FIG. 1.
Figure 3:
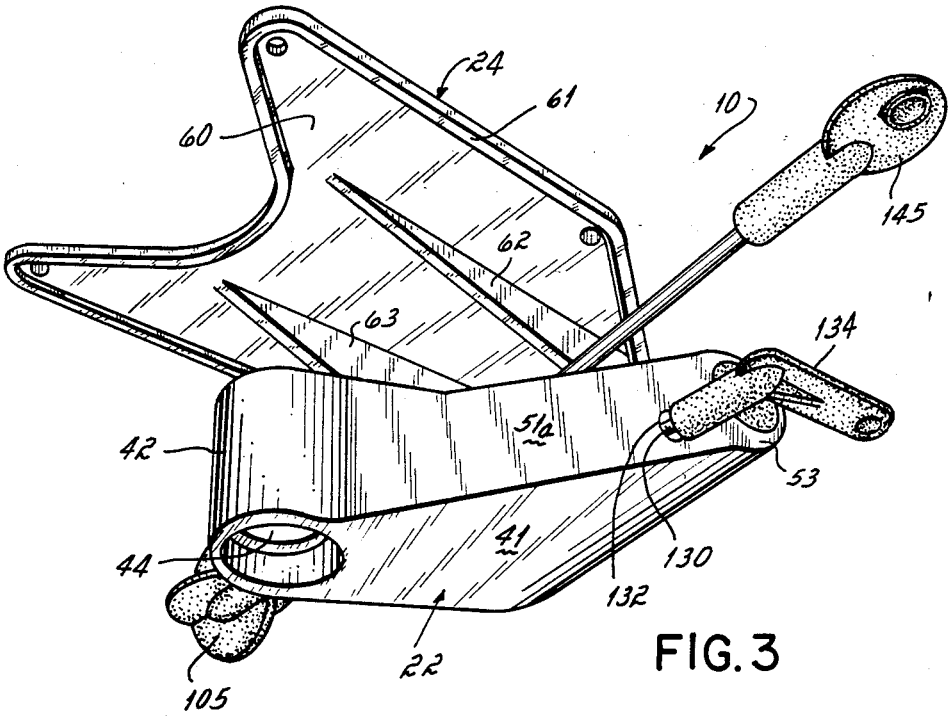
FIG. 3 is a perspective view of the bottom of the chair FIG. 1.
Figure 4:
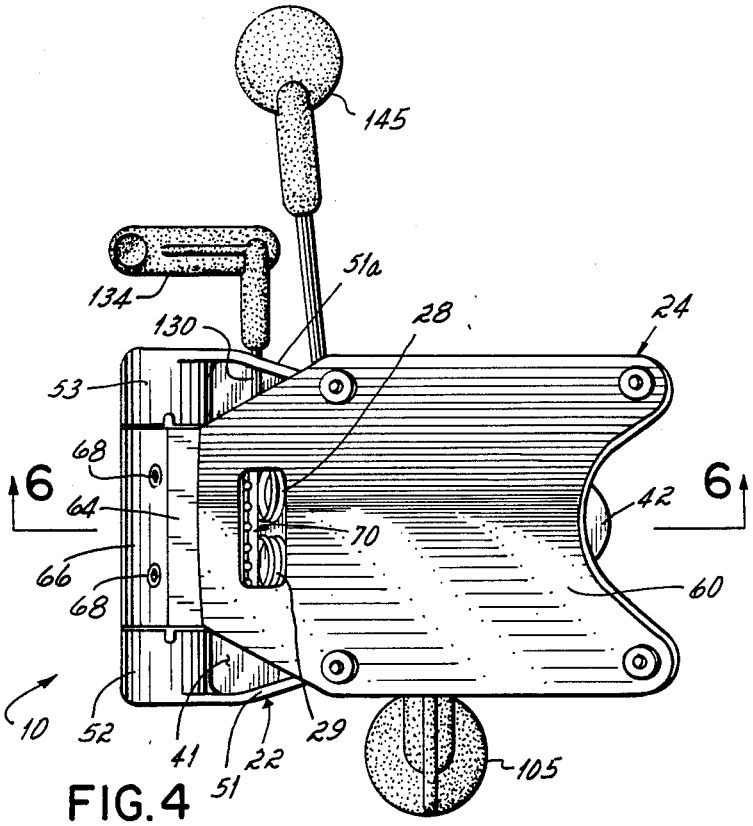
FIG. 4 is a top plan view of the chair control of FIG. 1.
Figure 5:
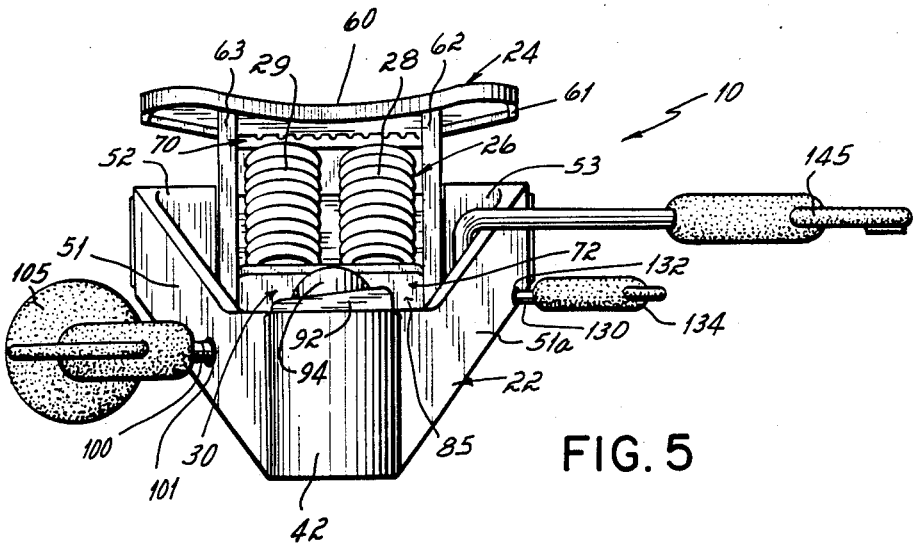
FIG. 5 is a rear elevational view of the chair control of FIG. 1.
Figure 6:
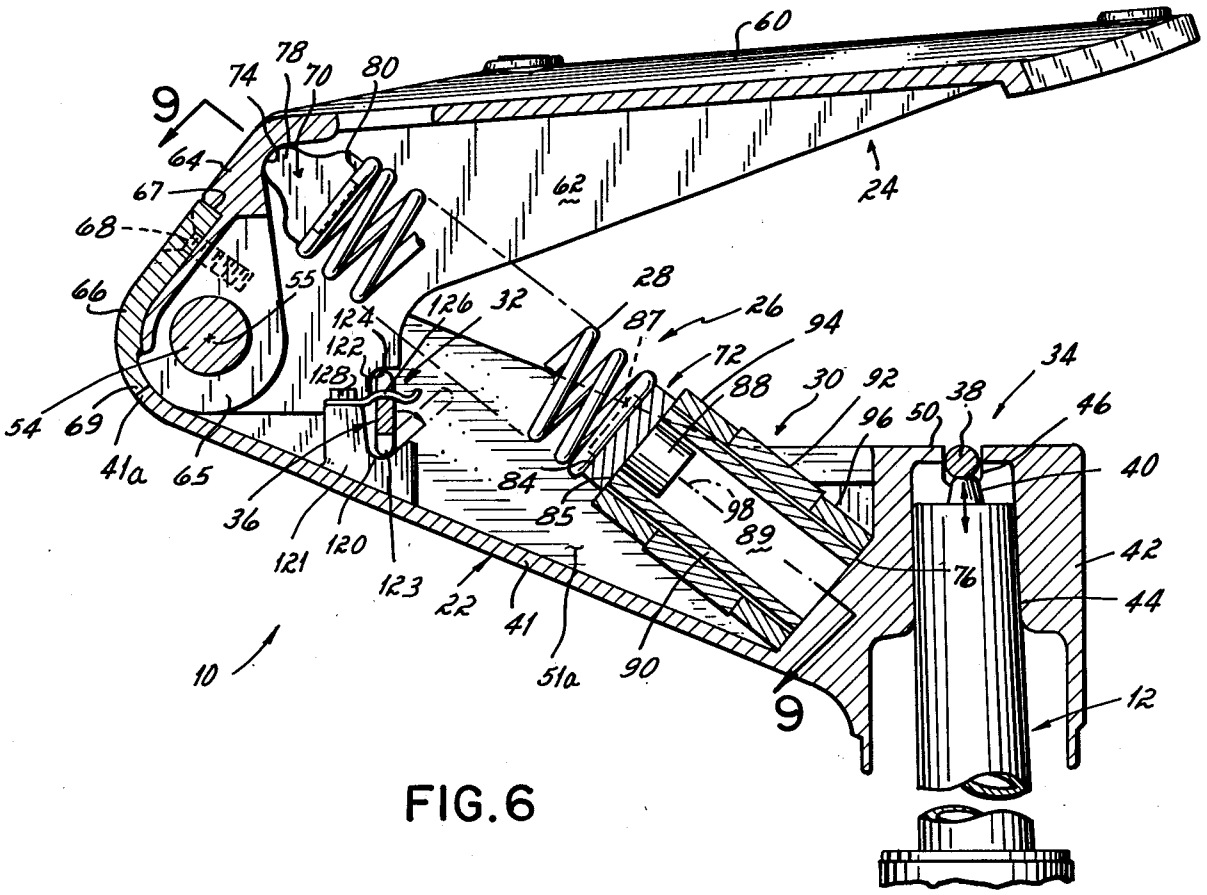
FIG. 6 is a cross-sectional view through the chair control taken on line 6—6 of FIG. 4.

With reference first to FIGS. 1 and 6, it will be seen that the chair control 10 of this invention is mounted upon the column 12 of a chair pedestal base 14. This control functions to maintain a person seated in a seat 18 of the chair 16 in an upright position while still permitting that person to tilt rearwardly when the person leans against the backrest 20 of the chair.

The chair control 10 comprises a bottom base plate 22, a seat support plate 24 pivotally mounted upon the base plate 22, and a tilt control mechanism 26, including a pair of compression springs 28 and 29 for biasing the seat support plate 24 to a normal at-rest position relative to the base plate 22. The tilt control mechanism also includes an adjustable spring preload mechanism 30 for preloading the compression springs 28 and 29. Additionally, the control 10 includes a seat tilt lock mechanism 32 and a seat lift control mechanism 34. The seat tilt lock mechanism 32 includes a lock lever 36 movable between a first position wherein it blocks relative movement of the seat support plate 24 relative to the base plate 22, and a second position (shown in phantom in FIG. 6) whereat this lock lever 36 is out of alignment with the seat support plate 24 and therefore permits tilting movement of the seat support plate 24 relative to the base plate 22. The seat lift control mechanism 34 includes a lift control arm 38 engageable with a plunger 40 of a gas cylinder (not shown) contained within the chair column 12 for effecting vertical adjustment of the chair seat.

BASE PLATE

Figure 7:
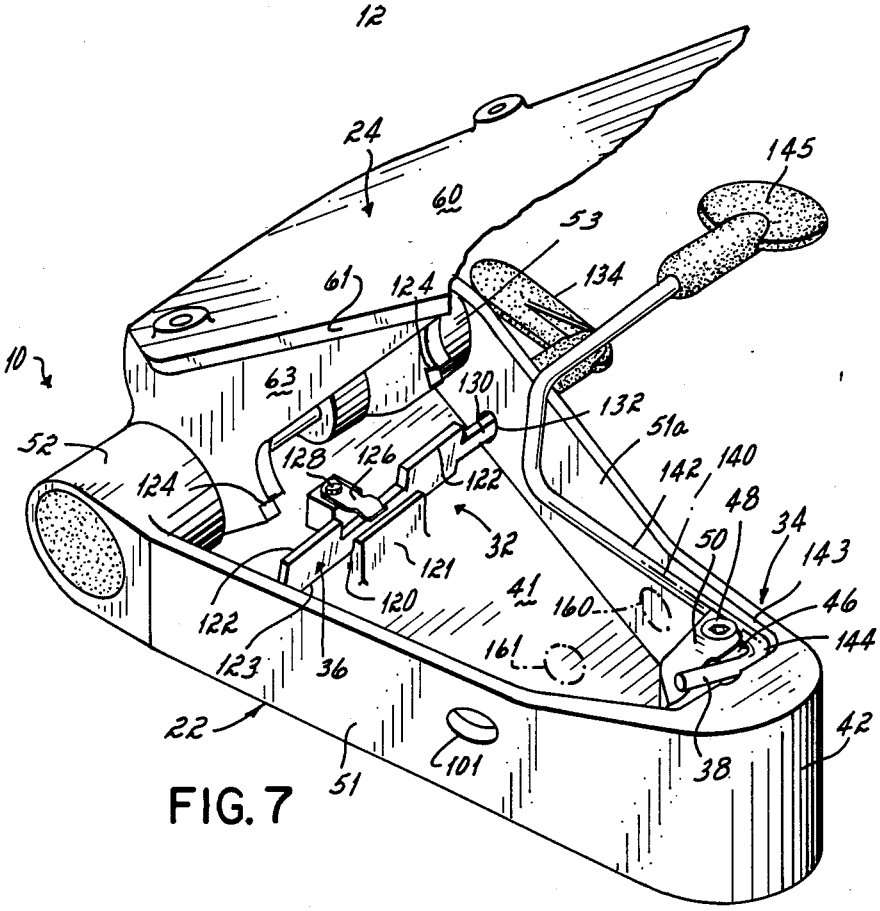
FIG. 7 is a perspective view of the chair control, but with the springs and the spring preload mechanism removed for purposes of better illustrating the seat tilt lock of the control.

In the preferred embodiment, the base plate 22 is a die casting, although it could as well be produced using other manufacturing or fabrication techniques. It comprises a bottom plate section 41 and a rear upstanding post section 42. This post section 42 has a vertical bore 44 extending therethrough and adapted to receive the upper end of the chair column 12. This bore 44 may be tapered or cylindrical, depending upon the shape of the upper end of the column 12. At its upper end, the bore 44 is intersected by a transverse slot 46 within which the lift control arm 38 of the seat lift control mechanism 34 is located. As best seen in FIG. 7, the left control arm 38 is secured for pivotal movement by the head 48 of a screw threaded into the top 50 of the rear post section 42 of the base plate 22. The screw head 48 secures the lift control arm 38 of the lift control mechanism to the rear post section 42 of the base plate so as to permit pivotal movement of the arm 38. Pivotal movement of the arm 38 in turn effects vertical movement of the spring bias plunger 40 of the gas cylinder (not shown) of the chair column 12.

The base plate 22 is generally triangular in configuration when viewed in top plan (see FIGS. 2, 3, 5 and 7). From the rear post section 42, the bottom plate section 41 of the base plate 22 extends outwardly toward the seat pivotal axis 55 at the front. Vertical walls 51, 51*a* extend upwardly from the side edges of the bottom plate section 41. At its forward end these sidewalls terminate in a pair of hubs 52, 53. These hubs support a seat pivot shaft 54 which extends across the front of the base plate 22 and supports the seat support plate 24 for pivotal movement about the axis 55 of the pivot shaft 54.

SEAT SUPPORT PLATE

The seat support plate 24 is also preferably a die casting. As best seen in FIGS. 2, 3, 4 and 6, the plate 24 comprises a generally planar top plate section 60 from which a peripheral flange 61 extends downwardly around the edge of the top plate section 60. A pair of spaced fins 62, 63 extend downwardly from the underside of the top plate section 60. These fins 62, 63 taper downwardly from the rear to the front of the seat support plate 24. At the front of the plate, these fins connect to a front plate section 64 of the seat support plate 24. This front plate section 64 extends across the full width of the front of the seat support plate 24. Attached to the lower front portion of the front plate section 64 there is an assembly lock plate 66. This plate fits into a recess 67 formed in the front of the front section 64 of the seat support plate 24 and is secured therein by screws 68. At its lower end, this assembly lock plate 66 curves inwardly and terminates in a bottom edge 69 engageable with the front edge 41*a* of the bottom plate section 41 of the base plate 22. Engagement of this lower edge 69 of the assembly lock plate 66 with the front edge 41*a* of the base plate 22 determines the at-rest position of the seat support plate relative to the base plate. This assembly lock plate functions to facilitate assembly of the chair control 10, as well as a finger pinch guard, all as explained more fully hereinafter.

The lower fins 62, 63 of the seat support plate 24 have hub sections 65 extending inwardly therefrom. These hub sections 65 are bored for reception of the seat pivot shaft 54 so as to enable the seat support plate 24 to be pivoted about the axis 55 of the seat support shaft 54.

TILT CONTROL MECHANISM

Figure 9:
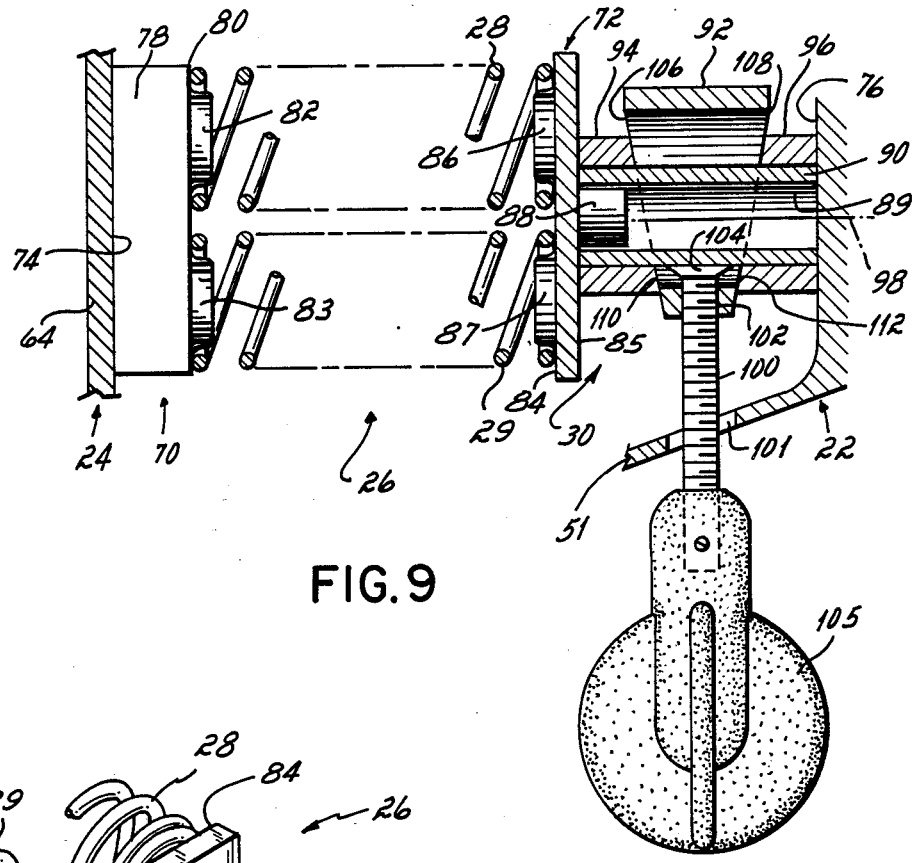
FIG. 9 is a fragmentary cross-sectional view taken on line 9—9 of FIG. 6.
Figure 10:
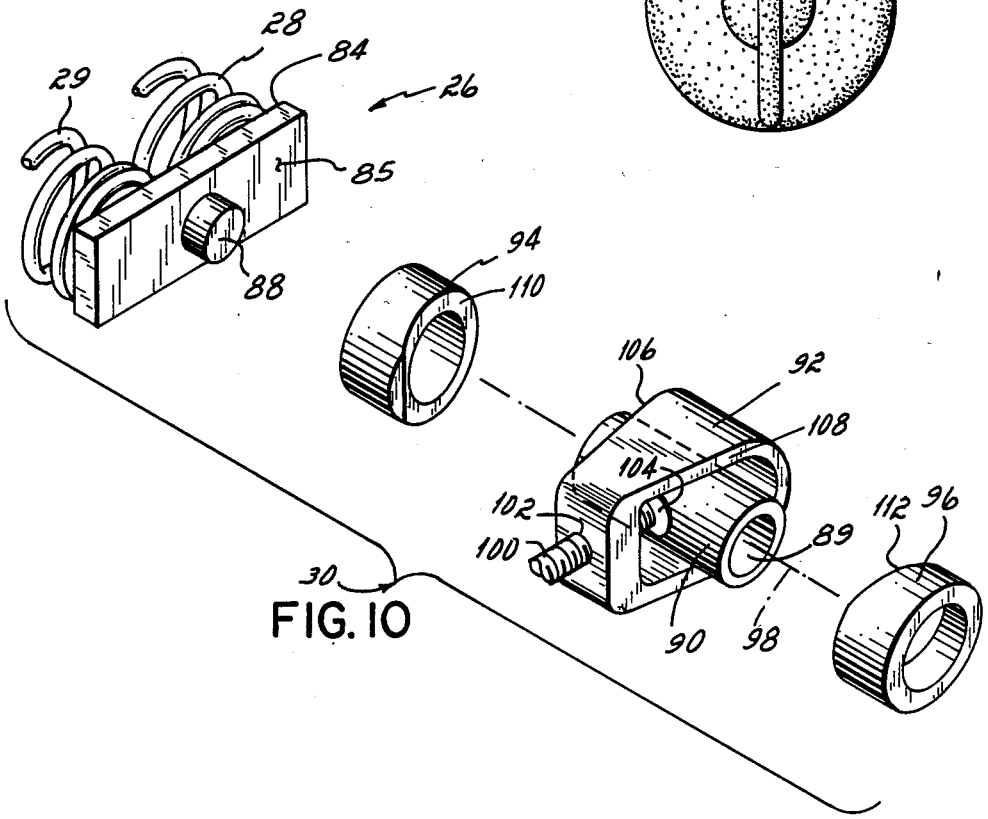
FIG. 10 is an exploded perspective view of the adjustable spring preload mechanism of the chair control of FIG. 1.

The tilt control mechanism 26 comprises the pair of compression springs 28, 29, a spring top adapter 70, a spring bottom adapter 72, and the adjustable spring preload mechanism 30, all of which extend between an arcuate recess 74 on the underside of the seat support plate 24 and a flat bottom seating surface 76 of the base plate 22. With reference particularly to FIGS. 6, 9 and 10, it will be seen that the spring top adapter 70 comprises a radiused upper end section 78 which rests against the arcuate recess 74 on the underside of the seat support plate 26. This end section 78 cooperates with the arcuate recess 74 to provide a pivot point for the tilt control springs 28, 29. The bottom surface 80 of this spring top adapter 70 is flat, as may be seen most clearly in FIG. 9. This flat surface 80 has a pair of protrusions 82, 83 which extend outwardly therefrom and are received within the interior of the upper end of the compression springs 28, 29. These protrusions thus function to locate the upper ends of the springs 28, 29.

The spring bottom adapter 72 has a pair of parallel flat surfaces 84, 85, the upper one 84 of which serves as a seating surface for the lower end of the springs 28, 29. Protrusions 86, 87, extending upwardly from the surface 84 of the adapter 72, serve to locate the lower ends of the springs 28, 29. A protrusion 88 extends downwardly from the underside of the flat surface 85 of the adapter 72 and is received within an axial bore 89 of a sleeve 90. The sleeve 90 in turn supports the adjustable spring preload mechanism 30 which extends from the underside or lower surface 85 of the spring bottom adapter 72 to the flat bottom surface 76 of the base plate 22.

ADJUSTABLE SPRING PRELOAD MECHANISM

The adjustable spring preload mechanism includes the sleeve 90, a generally tubular or hollow wedge-shaped cam 92 surrounding the sleeve 90 and movable over the surface of the sleeve 90, and a pair of annular cams 94, 96 also mounted over the sleeve 90. This adjustable preload mechanism is best illustrated in FIGS. 9 and 10. With reference to these figures it will be seen that the cam actuator 92 is generally wedge-shaped and movable laterally relative to the axis 98 of the sleeve 90 under the control of a screw 100. This screw is threaded through a bore 102 of the cam actuator 92 and has an expanded end 104 engageable with the peripheral surface of the sleeve 90 such that when the screw is rotated by a handle 105, it is operative to either pull the cam actuator 92 toward the handle or move it away from the handle 104, depending upon the direction of rotation of the handle.

The cam actuator 92 has a pair of opposed cam surfaces 106, 108 engageable with complementary cam surfaces 110, 112 of the annular cams 94, 96, respectively. These complementary cam surfaces on the annular cams cause the cam 94 to be moved axially over the surface of the sleeve 90 when the wedge-shaped cam actuator 92 is moved laterally relative to the sleeve and thus to the axis of the annular cams 94, 96. This axial movement of the annular cam 94 results in axial movement of the spring bottom adapter 72 toward or away from the spring top adapter 70, depending upon the direction of rotation of the handle 104. This movement of the spring bottom adapter 72 toward or away from the spring top adapter 70 in turn translates into greater or lesser preload of the tilt control springs 28, 29. That preload enables the chair control 10 to be thereby adjusted for ease of tilting movement by heavier or lighter persons seated in the chair.

SEAT TILT LOCK MECHANISM

The seat tilt lock mechanism is best illustrated in FIGS. 6 and 7. With reference to these figures, it will be seen that this mechanism comprises the seat tilt lock lever 36 which is pivotable within a recess 120 in the top surface of a lug 121 which extends upwardly from the bottom plate section 41 of the base plate 22. The top surface 122 of this lever is engageable with flats 124 on the underside of the fins 62, 63 of the seat support plate while the bottom edge surface 123 is engageable with the surface of the lug 121 on the base plate 22 to lock the seat support plate 24 against movement relative to the base support 22. A sheet metal leaf spring 126 secured to the top of the lug 121 by a screw 128 retains the seat tilt lock lever 36 in its locking position. To move the lever 36 out of this locking position and pivot it about the lower edge 123 to the position illustrated in phantom in FIG. 6, there is a shaft 130 which extends outwardly through a hole 132 in the sidewall 51*a* of the base plate 22. A handle 134 is mounted on the end of this shaft so as to facilitate rotational movement of the shaft 130 and lever 36 between a blocking position (shown in solid lines in FIG. 6) and a non-blocking or unlocked position (shown in phantom lines in FIG. 6). When in the locked position, the leaf spring 126 retains the lever in its locked position.

SEAT LIFT CONTROL MECHANISM

Figure 8:
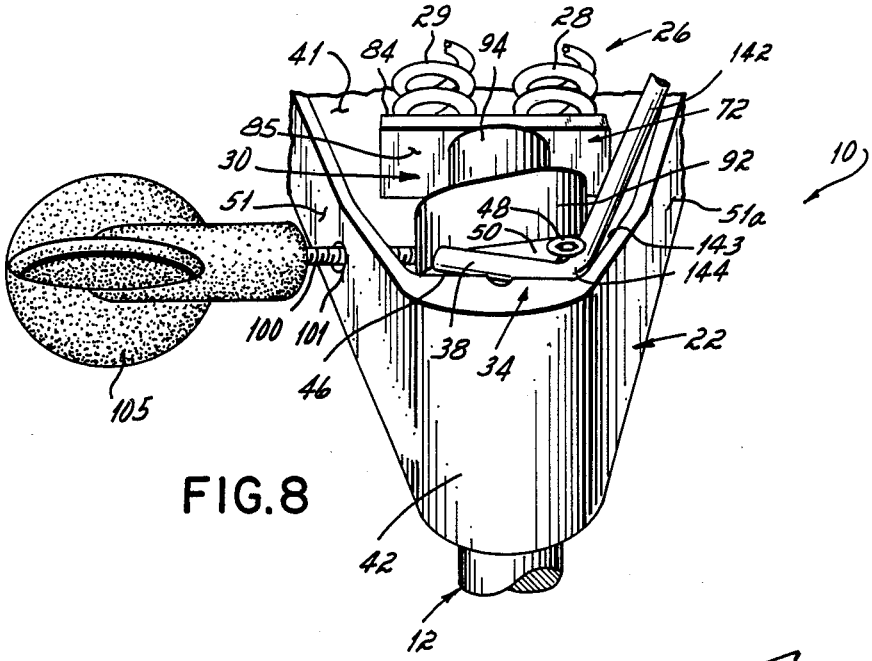
FIG. 8 is a fragmentary rear perspective view of the chair control illustrating the mounting of the lift control arm for varying the height of the chair control.

The seat lift control mechanism, as explained hereinabove, comprises the lift control arm 38 engageable with the plunger 40 of a conventional gas cylinder (not shown) to effect vertical movement of the chair seat relative to the pedestal base. This arm 38, as may be seen most clearly in FIGS. 7 and 8, extends inwardly from a handle pivotable about the axis 140 of a shaft 142 to which the arm is attached via a right angle bend 144. This shaft in turn extends from the arm 38 back along the inside surface of the sidewall 51*a* of the base plate and then upwardly and outwardly over the top surface of the sidewall. The head 48 of a screw mounted in the rear post section 42 of the base plate maintains the shaft 142 in a recess 143 of the rear post section 42 while permitting pivotal movement of the shaft about the axis thereof upon raising and lowering of a paddle 145. The paddle 145 is mounted on the outer end of the shaft such that the paddle may be lifted to cause the arm 38 to be moved downwardly to actuate the plunger 40 of the gas cylinder. When the plunger is in its innermost position, the chair seat may be lifted or moved downwardly to change or vary the height of the chair seat relative to the pedestal base.

ASSEMBLY OF CHAIR CONTROL

To assemble the chair control 10 and as best illustrated in FIG. 7, the seat tilt lock lever 36 is first inserted into the interior of the base plate 22 with the shaft 130 of the lever extending through the hole 132. The locking spring 126 is then secured to the top of the lug 121 on the interior of the base plate by the screw 128. The handle 134 is then added to the outer end of the shaft 130. The seat lift control lever 142 is then inserted into the axial recess 143 of the base plate with the lift control arm 38 located within the slot 46 in the rear post section 42 of the base plate 22. The screw having the head 48 is then secured by its threads to the top 50 of the rear post section so as to rotatably secure the lift control lever within the interior of the base plate 22. The paddle 145 may then be added to the outer end of the lift control lever 142. The adjustable spring preload mechanism 30 (FIG. 10) is then preassembled by locating the cam actuator 92 over the sleeve 90 and by placement of the annular cams 94, 96 over the opposite ends of the sleeve 90. At this time, the handle 105 on the outer end of the screw 100 is removed from the screw such that the screw may be inserted through a bore or hole 101 in the sidewall 51 of the base plate. The spring bottom adapter 72 is then positioned atop the adjustable spring preload mechanism 30 by having the lug or protrusion 88 on the underside of the adapter 72 inserted into the interior 89 of the sleeve 90.

The chair control 10 is now ready for insertion of the compression springs 28, 29. In accordance with the invention of this application, this insertion is made without the need to compress the springs. To that end, the assembly lock plate 66 is removed from the seat support plate 24 and the seat support plate 24 rotated counterclockwise, as viewed in FIG. 6, about the axis 55 to a position where the interior of the base plate is completely exposed. This counterrotation of the seat support plate 24 from the position illustrated in FIG. 6 is shown in FIG. 7 and is now possible because the assembly lock plate 66 is removed, and there is nothing to prevent rotation of the seat support plate relative to the axis 55 until the top surface of the seat support plate 24 engages the underside surface of the base plate 22. The compression springs 28, 29 are now mounted on the locating lugs 86, 87 of the spring bottom adapter 72. The spring top adapter 70 is then positioned atop the springs with the lugs 82, 83 of the top adapter 70 positioned within the interior of the springs. The seat support plate is now rotated back to the position illustrated in FIG. 6 in which the springs 28, 29 are now compressed. The springs are compressed to a degree slightly beyond that illustrated in FIG. 6 or to the degree illustrated in FIG. 6 at which the assembly lock plate 66 may be inserted into the recess 67 and secured within that recess by the screws 68. In the assembled position of the lock plate, the lower edge 69 of the lock plate 67 abuts the front edge 41*a* of the bottom plate section 40 of the base plate 22 and prevents clockwise rotation of the seat support plate beyond the position illustrated in FIG. 6.

One of the salient features of the invention of this application, and particularly of the adjustable spring preload mechanism 30 described hereinabove, is that that mechanism may be mounted in the chair control 10 with the adjustment screw 100 of the mechanism extending through either sidewall 51, 51*a* of the base plate or through a hole in the bottom plate section 41 of the base plate 22. All that is required in order to mount the spring preload control handle 104 on the opposite side of the control from the side in which it is illustrated in this application or on the underside of the control is to drill a hole at the location illustrated in phantom at 160 in FIG. 7 if the handle 105 is to be located on the opposite side of the control or to drill a hole at the location illustrated in phantom at 161 in this Figure if the handle 105 is to be located on the underside of the control. If holes are located in these phantom positions 160, 161, then the handle 105 of the spring preload mechanism may be positioned in either of these alternative positions.

While I have described only a single preferred embodiment of my invention, persons skilled in this art will appreciate changes and modifications which may be made without departing from the spirit of my invention. Therefore, I do not intend to be limited except by the scope of the following appended claims.

I claim:

1. A chair control adapted to be mounted upon a pedestal chair base, said control comprising a base plate having a front portion and a rear portion, means located adjacent the rear portion of said base plate for securement of said base plate to a vertical column of the pedestal chair base, a seat support plate pivotally secured to said base plate for tilting movement of said seat support plate about an axis located adjacent the front of said base plate, spring bias means including at least one compression spring operatively associated with said base plate and said seat support plate for biasing said seat support plate toward an at-rest position of said seat support plate relative to said base plate, and an assembly locking plate mounted on the front side of one of said base plate or seat support plate and engageable with the other of said base plate or seat support plate to determine the at-rest position of said seat support plate relative to said base plate, said assembly locking plate being removable from its mounting on said base plate or seat support plate during assembly of said chair control so as to enable said seat support plate to be tilted beyond the at-rest position of said seat support plate relative to said base plate for compression-free assembly of said at least one compression spring between said plates and then compressed between said plates while said assembly locking plate is mounted on the front side of said one of said base plate or seat support plate.

2. The chair control of claim 1 wherein said at least one compression spring comprises a pair of compression springs.

3. The chair control of claim 2 wherein said springs are maintained in compression in said assembly chair control between a top spring adapter engageable with said seat support plate and a bottom spring adapter, said top spring adapter serving to locate one end of said springs and as a pivot point for said one end of said springs relative to said seat support plate during tilting movement of said seat support plate about said axis.

4. The chair control of claim 3 wherein said bottom spring adapter serves to locate the other end of said springs against an adjustable spring preload mechanism.

5. The chair control of claim 4 wherein said adjustable spring preload mechanism comprises a sleeve located between said bottom spring adapter and said base plate, a generally wedge-shaped cam actuator mounted over said sleeve, said cam actuator having cam surfaces on opposite sides thereof, a pair of annular cams mounted over said sleeve on opposite sides of said cam actuator, said annular cams having cam surfaces complementary to and engageable with the cam surfaces of said wedge-shaped cam actuator, and means for effecting lateral adjustment of said cam actuator relative to said annular cams so as to move said annular cams toward and away from one another and thereby vary a preload of said springs.

6. A chair control adapted to be mounted upon a pedestal chair base, said control comprising a base plate having a front portion and a rear portion, means located adjacent the rear portion of said base plate for securement of said base plate to a vertical column of the pedestal chair base, a seat support plate pivotally secured to said base plate for tilting movement of said seat support plate about an axis located adjacent the front of said base plate, spring bias means including at least one compression spring operatively associated with said base plate and said seat support plate for biasing said seat support plate toward an at-rest position of said seat support plate relative to said base plate, and an adjustable spring preload mechanism located completely external of said at least one compression spring and operable between one end of said at least one spring and one of said base plate or seat support plate, said adjustable spring preload mechanism comprising a sleeve located between said one end of said at least one spring and one of said base plate or seat support plate, a generally wedge-shaped cam actuator mounted over said sleeve, said cam actuator having cam surfaces on opposite sides thereof, a pair of annular cams mounted over said sleeve on opposite side of said cam actuator, said annular cams having cam surfaces complementary to and engageable with the cam surfaces of said wedge-shaped cam actuator, and means extending horizontally from one side of said base plate for effecting lateral adjustment of said cam actuator relative to said annular cams so as to move said annular cams toward and away from one another and thereby vary the preload of said at least one spring.

7. The chair control of claim 6 wherein said at least one compression spring comprises a pair of compression springs.

8. The chair control of claim 7 wherein said springs are maintained in compression in said assembly chair control between a top spring adapter and a bottom spring adapter, said top spring adapter serving to locate one end of said springs and as a pivot point for said one end of said springs relative to said seat support plate during tilting movement of said seat support plate about said axis.

9. The chair control of claim 8 wherein said bottom spring adapter serves to locate the other end of said springs against an adjustable spring preload mechanism.

* * * * *